United States Patent [19]

Kirby

[11] Patent Number: 4,838,210

[45] Date of Patent: Jun. 13, 1989

[54] PRE-FORMED INSULATING REVERSING CHAMBER FOR MODIFIED SCOTCH BOILER OR THE LIKE

[75] Inventor: Richard H. Kirby, Arlington, Vt.

[73] Assignee: Burnham Corporation, Lancaster, Pa.

[21] Appl. No.: 216,098

[22] Filed: Jul. 7, 1988

[51] Int. Cl.[4] ..... F22B 7/12

[52] U.S. Cl. ..... 122/149; 122/75; 122/182 R

[58] Field of Search ..... 122/122, 149, 121, 182, 122/142, 141, 150, 151, 410, 75

[56] References Cited

U.S. PATENT DOCUMENTS 3,259,108 7/1966 Craig et al. ..... 122/149

3,848,573 11/1974 Phillips ..... 122/149

*Primary Examiner*—Edward G. Favors

*Attorney, Agent, or Firm*—Haynes N. Johnson

[57] ABSTRACT

A boiler having a first pass furnace and a set of second pass tubes, a reversing recess proximate to the furnace and tubes for reversing the flow of gases between the furnace and tubes, and a rear access door providing access to the recess, in which there is an integral, self-sustaining reversing chamber sized and configured to fit within and be removably held within recess. The chamber is enclosed by walls on all sides thereof except the side facing the recess which is open and concave. The chamber is formed of loosely-packed ceramic fibers with air entrapped between said fibers to provide greater insulation.

4 Claims, 2 Drawing Sheets

PRE-FORMED INSULATING REVERSING CHAMBER FOR MODIFIED SCOTCH BOILER OR THE LIKE

FIELD OF THE INVENTION

This invention relates to the field of boilers, in particular so-called modified Scotch boilers. It is directed to an integral, self-sustaining reversing chamber to be positioned between the first and second pass of the boiler, the chamber being made of flexible, light-weight material.

BACKGROUND OF THE INVENTION

Periodically dry-back Scotch boilers require replacement of the refractory material used as insulation in the hot gas reversing area located between the first pass furnace cylinder and the second pass tubes. In the past the refractory material has been formed of heavy brickwork or cast refractory cement which has been formed on, and secured to, the rear access door of the boiler.

Replacement has required the removal of the rear access door and removal and replacement of the refractory material by hand. Using a portable crane, a boiler repair service must remove the heavy rear door, lay it flat on the floor, break out the old refractory, form and cast the new, and allow at least two days for the cement to cure. Then the door must be reinstalled and the boiler fired gently until the refractory has fully cured. This whole process can take as much as three or four days, requires considerable down time, and can be a serious problem if it occurs during the heating season or if an industrial process must be interrupted.

BRIEF SUMMARY OF THE INVENTION

A replaceable reversing chamber has been provided which is light-weight, self-supporting, and not dependent upon a heavy and complicated door assembly. The chamber is made as a separate piece, integral in itself, and not formed as part of the boiler or its rear access door. It is sized and configured so as to fit within a reversing recess in the boiler proximate to the rear access door and has a concave side facing the exit of first pass furnace and the entrance of the second pass tubes.

The chamber is vacuum-formed of light-weight ceramic fiber and is loosely-packed relative to the density of cast refractory materials; it has air pockets which provide added insulation. This molded fiber unit has sufficient flexibility to withstand flexing resulting from repeated heating and cooling.

DETAILED DESCRIPTION OF THE INVENTION

Figures 1, 2:
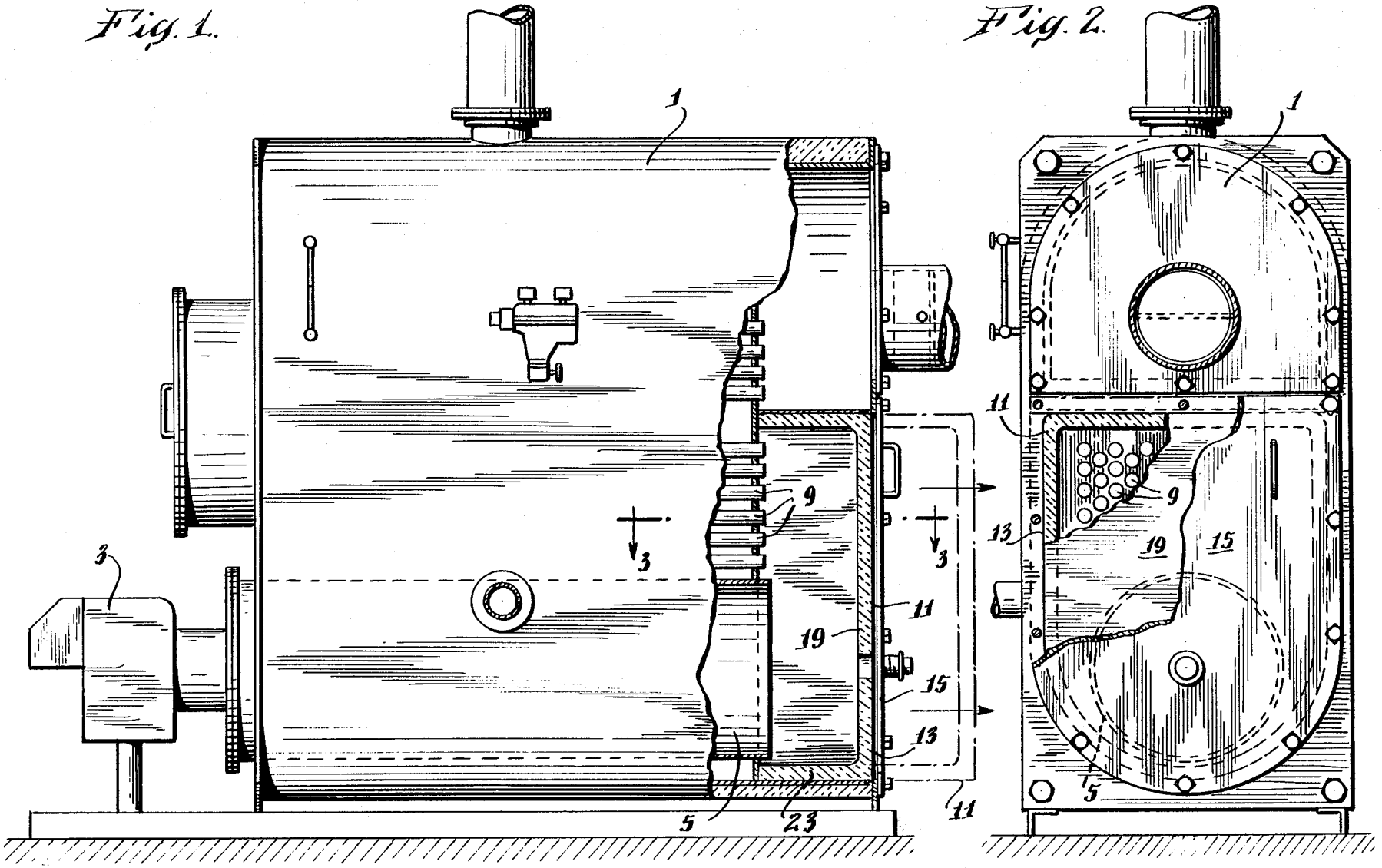
FIG. 1 is a side elevation, partially broken away, of a modified Scotch boiler of a type capable of using my invention. A partially removed reversing chamber is shown in phantom.
FIG. 2 is a similar rear elevation.

FIGS. 1 and 2 show a boiler 1 using my invention. The boiler includes gas, oil, or combination gas/oil burner 3 firing into furnace 5. Hot combustion gases flow from first-pass furnace 5, are reversed in direction in reversing chamber 11, and then enter second pass tubes 9.

The reversing chamber 11 of my invention replaces the usual refractory material used to reverse the direction of gas flow. It is a prefabricated unitary piece which fits within the plenum area (reversing recess) used for the reversing of gases. Thus, there is a reversing recess 13 in the boiler between furnace 5 and second-pass tubes 9 on one side and rear access door 15 on the other. Reversing chamber 11 is concave and is shaped to fit within and conform to the dimensions of this recess.

Figure 4:
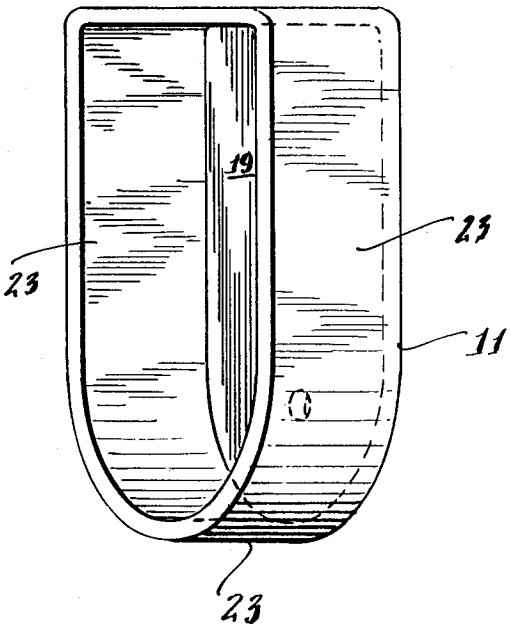
FIG. 4 is a perspective view of the chamber itself.
Figure 3:
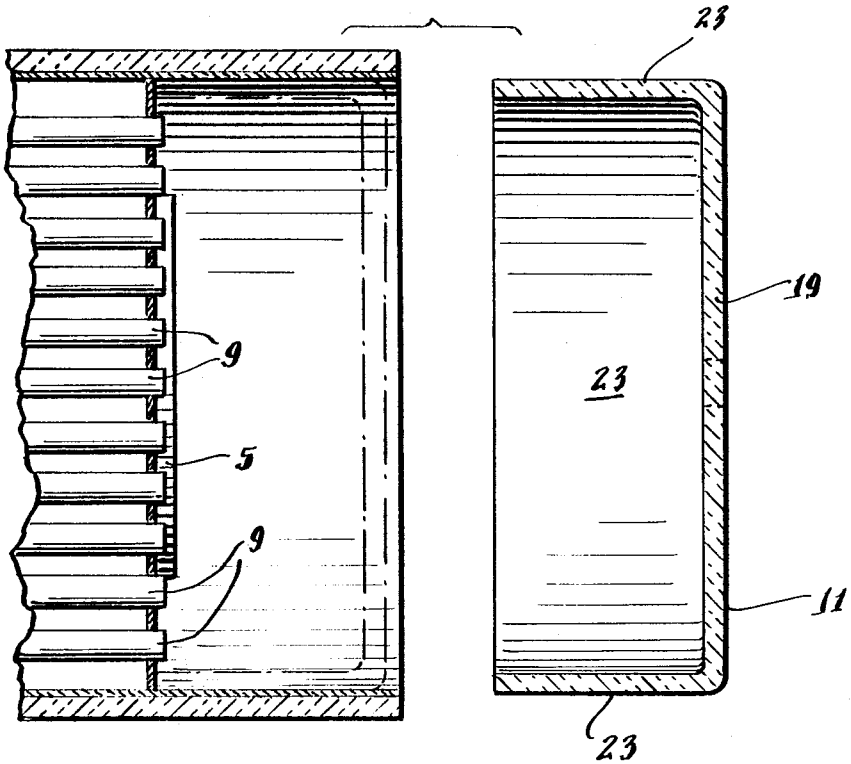
FIG. 3 is an exploded section, taken on line 3—3 of FIG. 1, showing the replaceable reversing chamber of my invention with the chamber removed. The chamber is shown in phantom in position in the boiler.

As seen in FIGS. 3 and 4, chamber 11 is a shell which has a closed rear wall 19 which fits against rear access door 15, a flat top wall which fits against the upper surface of chamber recess 13, and peripheral walls 23 forming the side and bottom. Thus, it forms a reversing chamber which is open and concave on the side facing the furnace 5 and second-pass tubes 9 (to the left as seen in FIGS. 1, 3, and 4). Hot gases enter in its lower portion from first pass furnace 5, are reversed in direction by reversing chamber 11, and leave through second pass tubes 9.

Reversing chamber 11 is a self-supporting, integral unit capable of being installed and removed in chamber recess 13, and conforming to the shape of recess 13. It is held in place by rear access door 15 and the walls of recess 13. It is, however, separate from, not formed as part of, door 15.

Since the reversing chamber itself is light-weight, one man can usually lift it alone. As it is self-supporting, it is not dependent upon a heavy and complicated door assembly; the rear door 15 can be a simple lift-off design.

Chamber 11 is made by vacuum-forming light-weight ceramic fiber, the fiber being relatively loosely packed compared to the density of cast refractory and, so, has air entrapped between the fibers. This molded fiber will easily withstand, without deterioration, flexing due to repeated heating and cooling.

The materials preferably used in construction of the chamber are fibers of alumina ($Al_2O_3$) and of silica ($SiO_2$), each 50% by weight. These solid materials are blended with a mixture of water and a binder of ordinary organic starch. This slurry is pulled by vacuum onto a form (configured the same as recess 13) and allowed to dry. It may be installed in or removed from the boiler simply by opening rear access door 15 and inserting it into, or removing it from, recess 13.

When the boiler is in operation, the fibers on the interior face of the chamber reach incandescence almost immediately, while the back of the chamber remains relatively cool. Similarly, the chamber cools rapidly on shutdown, unlike heavy cast refractory.

When replacement of the reversing chamber 11 is required, one simply opens the rear access door 15, removes the old chamber and inserts a new one. The process can be completed in hours, rather than days.

I claim:

1. In a boiler having a first pass furnace and a set of second pass tubes, a reversing recess proximate to said passes positioned for reversing the flow of gases between said passes, and a rear access door providing access to said recess, that improvement including an integral, self-sustaining reversing chamber, said chamber being formed of insulating material and being sized and configured to fit within and be removably held by said recess, said chamber being enclosed by walls on all sides thereof except the side facing said recess, with said side facing said recess defining a concave portion, whereby hot gases exiting from said first pass furnace will enter said concave portion and be deflected to said set of second pass tubes, and said reversing chamber can readily be replaced in said recess.

2. In a reversing chamber as set forth in claim 1, that improvement in which said insulating material is formed of loosely-packed ceramic fibers with air entrapped between said fibers, whereby the insulating capacity of said reversing chamber is enhanced.

3. An insulated, self-supporting reversing chamber for use in boilers having a chamber recess and a furnace leading to said recess, said chamber being of predetermined configuration and including a shell made of insulating material, said shell being dimensioned and shaped to conform to the size and shape of said chamber recess and having walls on all sides thereof conforming to said chamber recess except on the side facing said furnace, said latter side being concave, and said shell being self-sustaining, whereby said shell may readily be inserted into and removed from said chamber recess.

4. A reversing chamber as set forth in claim 3 in which said insulating material is high-temperature insulating fiber sufficiently loosely packed as to provided insulating air pockets therein.

* * * * *